US009393973B2

(12) United States Patent
Matsumoto et al.

(10) Patent No.: US 9,393,973 B2
(45) Date of Patent: Jul. 19, 2016

(54) DUAL-STRUCTURE STORAGE BOX OF RAILCAR AND RAILCAR INCLUDING SAME

(71) Applicant: KAWASAKI JUKOGYO KABUSHIKI KAISHA, Kobe-shi, Hyogo (JP)

(72) Inventors: Mitsuhiro Matsumoto, Kobe (JP); Naoyuki Sanada, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 43 days.

(21) Appl. No.: 14/389,155

(22) PCT Filed: Mar. 26, 2013

(86) PCT No.: PCT/JP2013/002046
§ 371 (c)(1),
(2) Date: Sep. 29, 2014

(87) PCT Pub. No.: WO2013/145715
PCT Pub. Date: Oct. 3, 2013

(65) Prior Publication Data

US 2015/0059613 A1 Mar. 5, 2015

(30) Foreign Application Priority Data

Mar. 27, 2012 (JP) ..... 2012-070604

(51) Int. Cl.
*B61D 49/00* (2006.01)
*B61D 17/00* (2006.01)
*B61C 17/04* (2006.01)

(52) U.S. Cl.
CPC ..... *B61D 49/00* (2013.01); *B61C 17/04* (2013.01); *B61D 17/00* (2013.01)

(58) Field of Classification Search
CPC ..... B61D 27/00; B61D 49/00; B61D 17/00; B61C 17/00; B61C 17/04; B60S 1/02
See application file for complete search history.

(56) References Cited

U.S. PATENT DOCUMENTS 2,655,092 A * 10/1953 Spooner ..... B60H 1/00464 165/127
2,738,171 A * 3/1956 Walton ..... B60S 1/02 165/100

(Continued)

FOREIGN PATENT DOCUMENTS

JP U 47-25129 11/1972
JP U 62-74384 5/1987

(Continued)

OTHER PUBLICATIONS

Oct. 28, 2015 Search Report issued in European Patent Application No. 13770261.9.

(Continued)

*Primary Examiner* — Jason C Smith
(74) *Attorney, Agent, or Firm* — Oliff PLC

(57) ABSTRACT

A dual-structure storage box is used in a railcar and stores device units. The dual-structure storage box includes a device receiver case and a storage case. The device receiver case is fixed to a floor of the railcar, and the device units are attached to the device receiver case. The storage case is configured separately from the device receiver case, covers the device receiver case from an outer side of the device receiver case, and stores the device units.

7 Claims, 8 Drawing Sheets

(56) References Cited

U.S. PATENT DOCUMENTS

| | | | | |
|---|---|---|---|---|
| 3,855,450 | A * | 12/1974 | O'Connor | B61C 17/04 165/127 |
| 4,949,218 | A * | 8/1990 | Blanchard | H05K 7/206 165/104.33 |
| 6,480,672 | B1 * | 11/2002 | Rosenzweig | F24H 3/0417 392/365 |
| 2015/0059613 | A1 * | 3/2015 | Matsumoto | B61D 17/00 105/396 |

FOREIGN PATENT DOCUMENTS

| | | |
|---|---|---|
| JP | U 63-16936 | 2/1988 |
| JP | A 8-108848 | 4/1996 |
| JP | A 2001-260877 | 9/2001 |
| JP | A 2002-120720 | 4/2002 |
| JP | A 2007-288908 | 11/2007 |
| JP | A 2008-41718 | 2/2008 |
| TW | M285275 U | 1/2006 |
| WO | 2010065903 A1 | 6/2010 |

OTHER PUBLICATIONS

Dec. 23, 2014 Office Action issued in Taiwanese Patent Application No. 102110807.

Translation of Dec. 23, 2014 Search Report issued in Taiwanese Patent Application No. 102110807.

International Search Report issued Jun. 18, 2013 in International Patent Application No. PCT/JP2013/002046.

* cited by examiner

DUAL-STRUCTURE STORAGE BOX OF RAILCAR AND RAILCAR INCLUDING SAME

TECHNICAL FIELD

The present invention relates to a dual-structure storage box of a railcar and a railcar including the dual-structure storage box, the dual-structure storage box being configured to store a device unit.

BACKGROUND ART

In railcars, various device units are included in railcar inner spaces, such as a driver's seat. These device units are provided so as to be stored in a storage box (also called a "cover"), such as an interior plate described in PTL 1. For example, a frame is welded to an inner side of such storage box, and the stiffness of the storage box itself is increased by this frame. In addition, the frame also serves as a device receiver at which the device unit is provided. The device unit is fixed to the frame by fastening members, such as bolts, to be arranged in the storage box. The storage box configured as above is welded to a structure of the railcar.

CITATION LIST

Patent Literature

PTL 1: Japanese Laid-Open Utility Model Application Publication No. 63-16936

SUMMARY OF INVENTION

Technical Problem

The structure of the railcar is assembled by welding a plurality of plate members made of metal, such as stainless steel or aluminum. Therefore, the plate members distort by heat of the welding, so that the dimensional accuracy of a bodyshell is low. In addition, the frame of the storage box is fixed to the storage box by welding, so that the frame and the storage box distort by the heat of the welding. Therefore, in a case where screw holes for fastening the device unit to the frame are formed in advance by tapping, because of heat distortion of the structure, the storage box, and the frame, fastening holes of the device unit and the screw holes are not positioned to coincide with each other, so that the device unit cannot be fastened to the frame, or the device unit may interfere with the structure or the storage box.

To avoid these cases, when fixing the storage box to the structure, first, the frame is welded to the storage box, and next, the storage box is welded to the structure. After that, the screw holes are formed on the frame by the tapping such that the positions thereof coincide with the positions of the fastening holes of the device unit. Then, the device unit is fastened to the frame. Further, to improve the appearance, the surface of the storage box may be painted, or a decorative plate may be provided at the storage box.

These work (welding, tapping, decorative finish, and the like) are performed in order, so that if previous work does not finish, subsequent work cannot be started. Therefore, a large amount of time is consumed for the arrangement of the storage box.

Here, an object of the present invention is to provide a dual-structure storage box of a railcar, the dual-structure storage box being able to improve a time required for arrangement work.

Solution to Problem

A dual-structure storage box of a railcar of the present invention is a dual-structure storage box storing a device unit and includes: a device receiver case which is fixed to a carbody of the railcar and at which the device unit is provided; and a storage case which is configured separately from the device receiver case and covers the device receiver case from an outer side of the device receiver case and in which the device unit is stored.

According to the present invention, the device receiver case and the storage case are configured separately. Therefore, the heat distortion caused when welding the device receiver case to the storage case does not occur, and even after the device receiver case is fixed to the carbody, the dimensional accuracy of the device receiver case can be maintained at a high level. Therefore, the carbody can be subjected to the tapping in advance. The device unit can be stored in the storage case only by covering the device receiver case with the storage case from the outer side of the device receiver case after the device receiver case is attached to the carbody. Therefore, the storage case can be subjected to decorative finish in advance. As above, work, such as the tapping and the decorative finish, can be performed in advance, so that a time it takes to perform the arrangement work of the dual-structure storage box of the railcar can be improved.

Advantageous Effects of Invention

The present invention can provide a dual-structure storage box of a railcar, the dual-structure storage box being capable of improving the time required for the arrangement work.

The above object, other objects, features, and advantages of the present invention will be made clear by the following detailed explanation of preferred embodiments with reference to the attached drawings.

DESCRIPTION OF EMBODIMENTS

Figure 1:
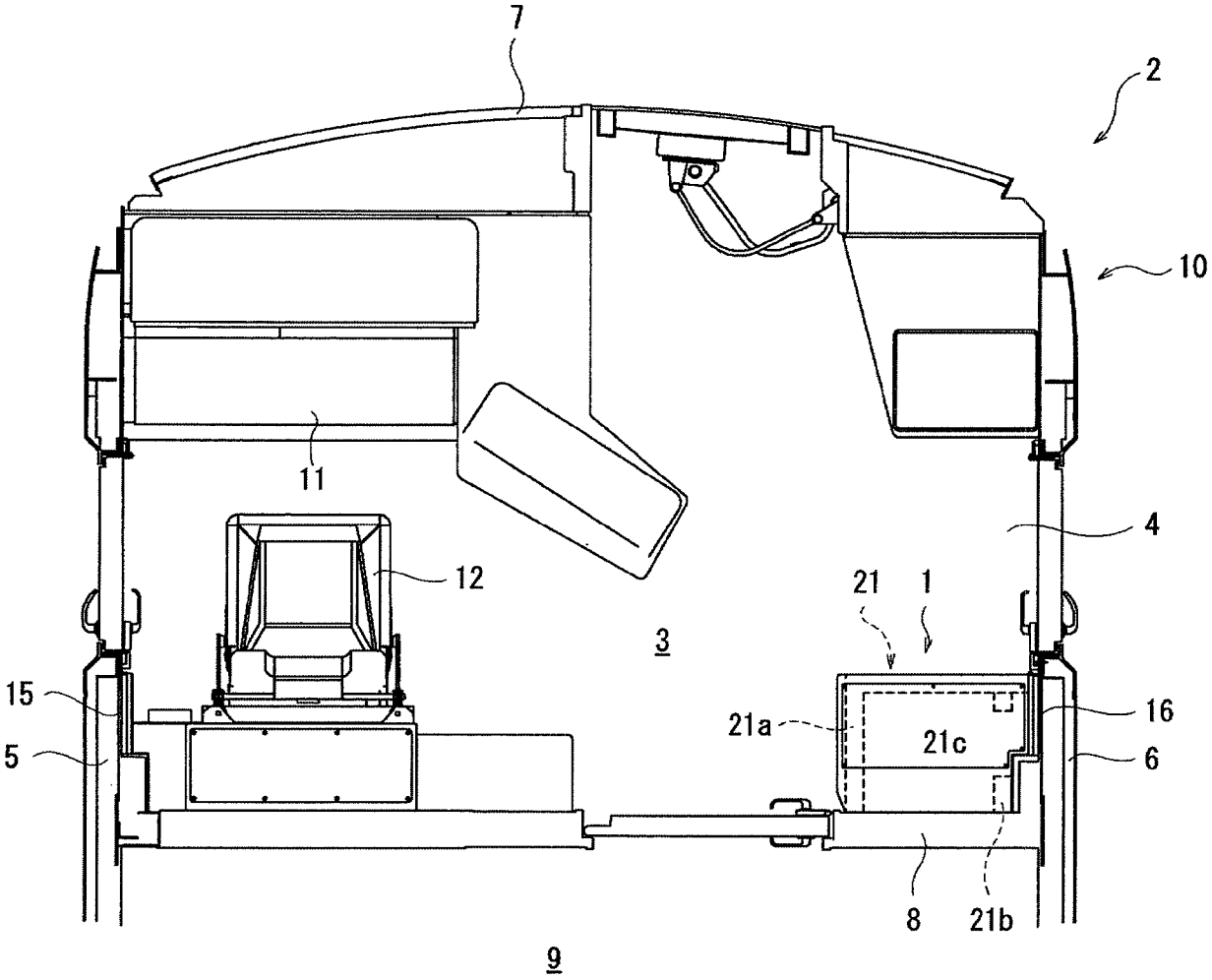
FIG. 1 is a plan view of a dual-structure storage box included in a driver's cab of a railcar when viewed from above.

Hereinafter, a dual-structure storage box (hereinafter simply referred to as a "storage box") 1 of a railcar of each of embodiments according to the present invention will be explained in reference to the drawings. A concept of directions in respective embodiments corresponds to a concept of directions when a running direction of a railcar (hereinafter may be simply referred to as a "car") is defined as a front direction. To be specific, a railcar longitudinal direction corresponds to a front-rear direction, and a railcar width direction corresponds to a left-right direction. The storage box 1 explained below is just one embodiment of the present invention. To be specific, the present invention is not limited to the embodiments below. Additions, deletions, and modifications may be made within the scope of the present invention.

A rail train is constituted by coupling a plurality of cars, and a front car 2 is located at the forefront among the plurality of railcars. The front car 2 is constituted by a bogie (not shown) and a carbody 10 mounted on the bogie. The carbody 10 includes a floor 4, and side bodyshells 5 and 6 respectively stand at left and right end portions of the floor 4. An interior portion 15 is provided at an inner side of the side bodyshell 5, and an interior portion 16 is provided at an inner side of the side bodyshell 6. A roof bodyshell (not shown) is provided at upper portions of the side bodyshells 5 and 6. A front bodyshell 7 is provided at a front portion of the carbody 10, and the front portion of the carbody 10 is closed by the front bodyshell 7. An end bodyshell (not shown) is provided at a rear portion of the carbody 10, and a rear end portion of the carbody 10 is closed by the end bodyshell.

A dividing plate 8 is provided inside the carbody 10 configured as above. The inside of the carbody 10 is divided by the dividing plate 8 into a driver's cab 3 located at the front side and a passenger room 9 located at the rear side. A driver's platform 11 is arranged at a front left portion of the driver's cab 3, and a driver's seat 12 where a driver sits is provided behind the driver's platform 11. A case receiving frame 21 at which the storage box 1 is arranged is arranged at a rear right portion of the driver's cab 3, specifically at a rear right corner close to the side bodyshell 6 and the dividing plate 8.

Case Receiving Frame

As shown in FIG. 1, the case receiving frame 21 is provided on the floor 4 and includes two case receiving frame members 21 and 21*b*. The first case receiving frame member 21*a* has a substantially L shape in plan view. A first end surface of the first case receiving frame member 21*a* is positioned along the interior portion 16, which is provided at the side bodyshell 6, to be welded to the interior portion 16. A second end surface of the first case receiving frame member 21*a* is positioned along the dividing plate 8 to be welded to the dividing plate 8. The first case receiving frame member 21*a* includes a projecting portion 21*c* located in the vicinity of the first end surface to project toward the dividing plate 8. Then, the second case receiving frame member 21*b* is provided behind the projecting portion 21*c* to be located on an extended line of the projecting portion 21*c*. The second case receiving frame member 21*b* extends in the front-rear direction and has a rectangular shape in plan view. A rear end surface of the second case receiving frame member 21*b* is positioned along the dividing plate 8 to be welded to the dividing plate 8.

The storage box 1 is mounted on the case receiving frame 21 arranged as above. To fasten the storage box 1 to the case receiving frame 21, a plurality of tap holes 24*a* to 24*f* (fastening holes) are formed on the case receiving frame 21. In the present embodiment, six tap holes 24*a* to 24*f* are formed on the case receiving frame 21. The first tap hole 24*a* is formed on the second case receiving frame member 21*b*, and the second to sixth tap holes 24*b* to 24*f* are formed on the first case receiving frame member 21*a*.

The plurality of tap holes 24*a* to 24*f* may be formed on, for example, a case receiving frame of a conventional technology. The case receiving frame of the conventional technology is constituted by a plurality of parts, and these parts are welded to one another while adjusting the positions of the parts. Therefore, it is difficult to accurately position and provide the parts of the conventional case receiving frame. If tapping is performed before the welding of the parts, tap holes are not arranged at accurate positions, so that the storage box 1 cannot be accurately fastened to the conventional case receiving frame. On this account, according to the conventional technologies, after the case receiving frame is welded, the tapping is performed. With this, the tapping needs to be performed after the welding, and it requires a large amount of time to clean chips generated by the tapping.

According to the case receiving frame 21, the tap holes 24*b* to 24*f* are formed on the integrated first case receiving frame member 21*a*. Therefore, a positional relation among the tap holes 24*b* to 24*f* does not change even after the welding. On this account, before the case receiving frame 21 is welded to the carbody 10, the tapping can be performed with respect to the case receiving frame 21. With this, the tap holes 24*b* to 24*f* can be formed with a high degree of positional accuracy when manufacturing the case receiving frame 21, and a time it takes to arrange the storage box 1 can be shortened. In addition, it is unnecessary to clean the chips, so that the above arrangement time can be further shortened. The storage box 1 is mounted on and fastened to the case receiving frame 21 configured as above.

Dual-Structure Storage Box

Figure 2:
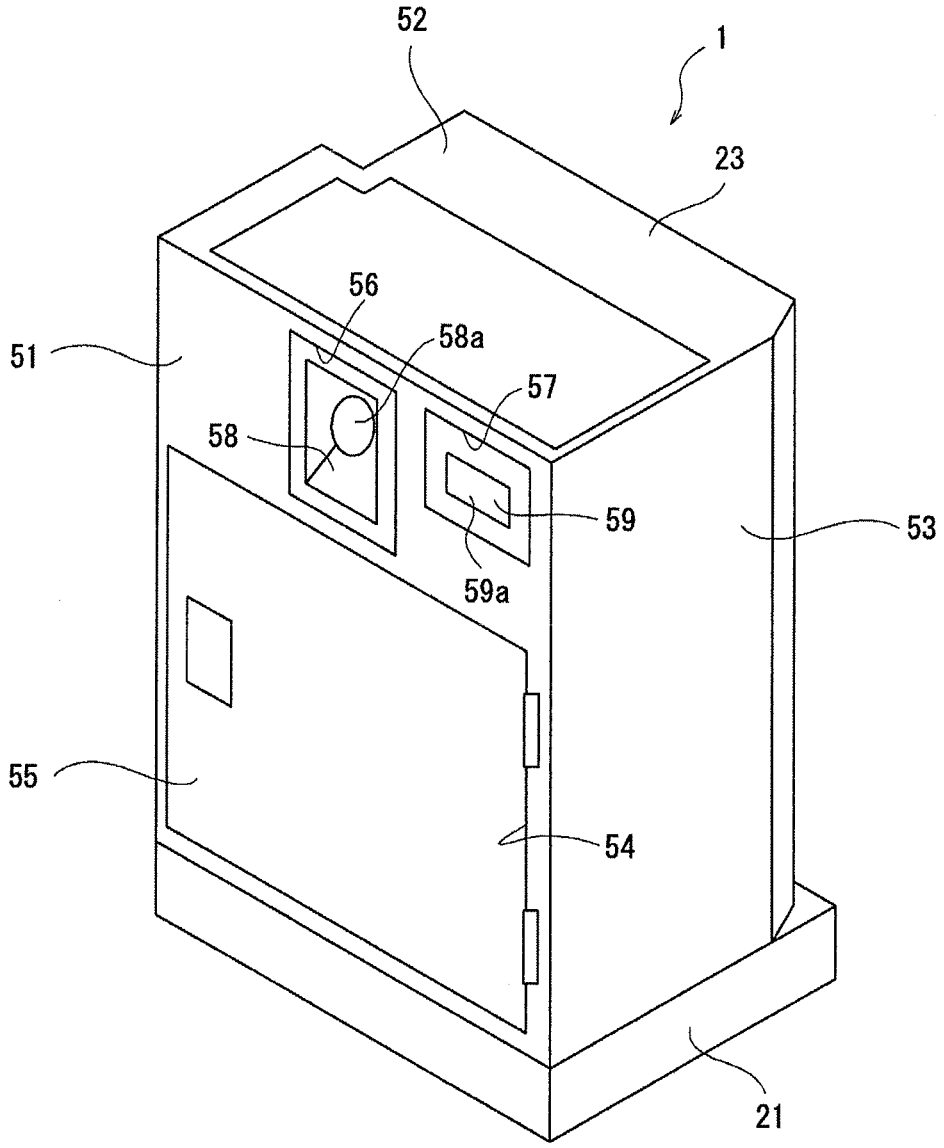
FIG. 2 is a perspective view of the dual-structure storage box of FIG. 1 when viewed obliquely from above.
Figure 3:
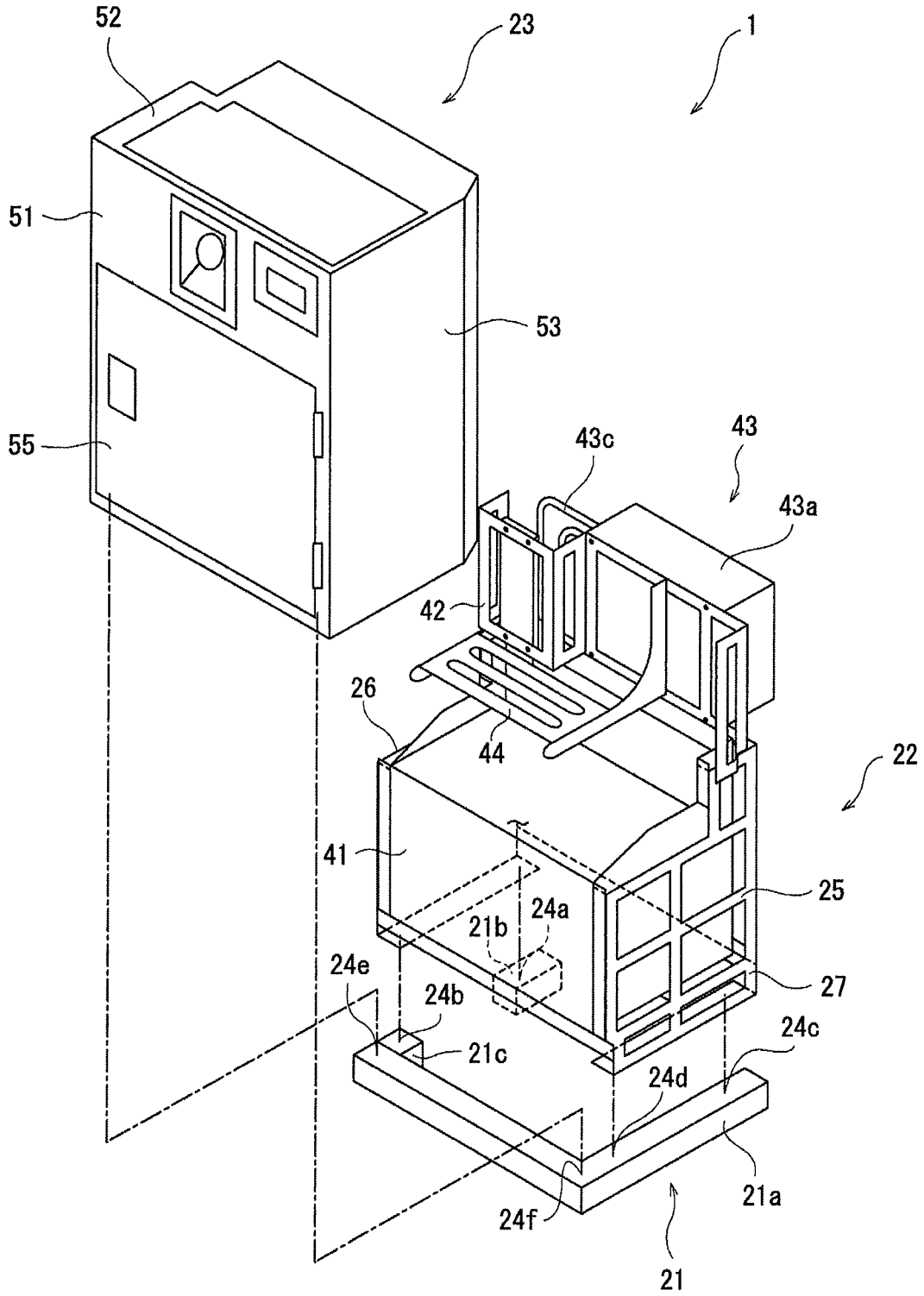
FIG. 3 is an exploded perspective view of the dual-structure storage box of FIG. 2.

The storage box 1 is a box in which below-described device units 41 and 43 are stored. The storage box 1 is constituted in a substantially rectangular solid shape as shown in FIG. 2. As shown in FIG. 3, the storage box 1 includes a device receiver case 22 and a storage case 23.

Device Receiver Case

Figure 4:
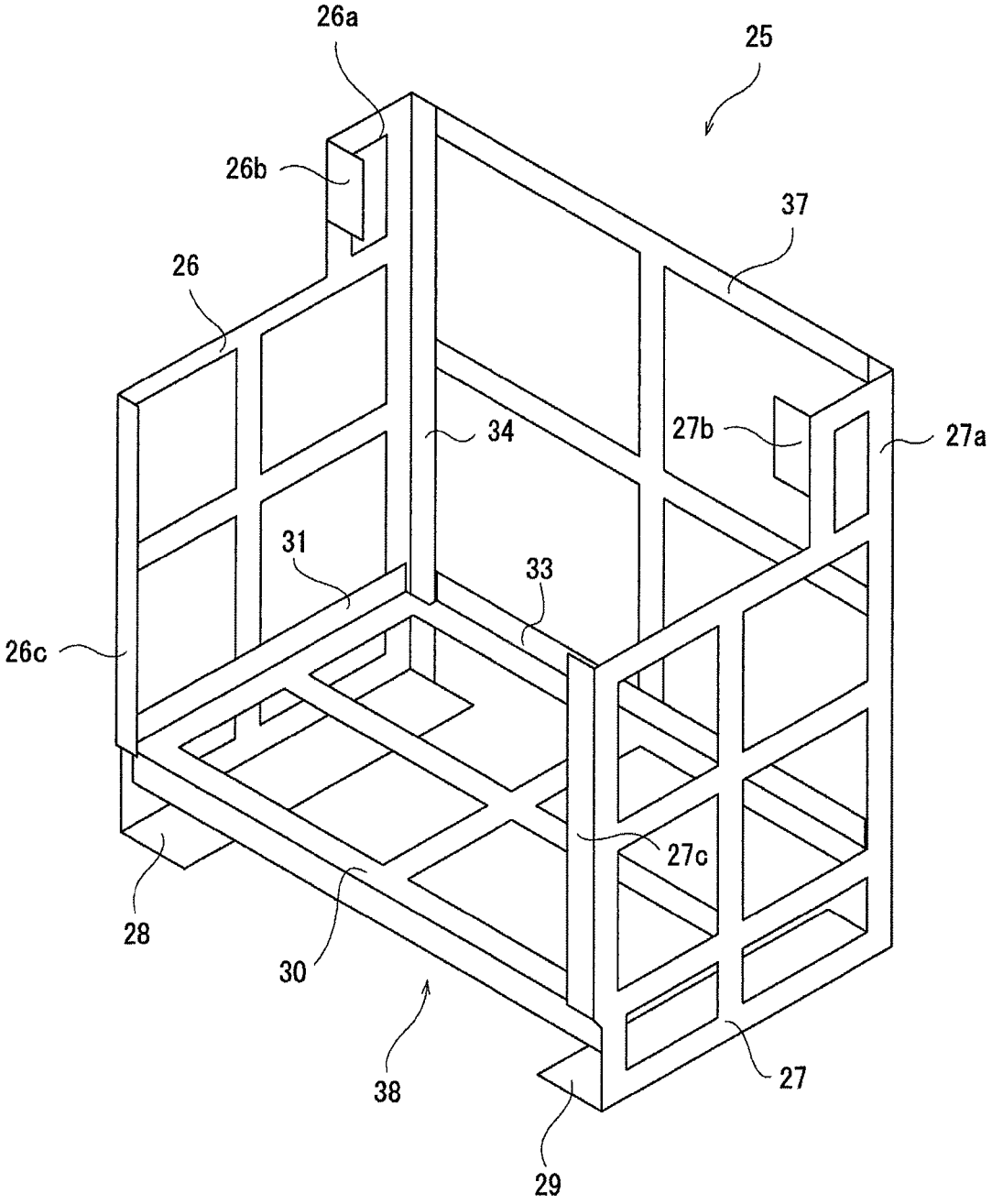
FIG. 4 is a perspective view of a device receiver case of FIG. 3 when viewed obliquely from above.
Figure 5:
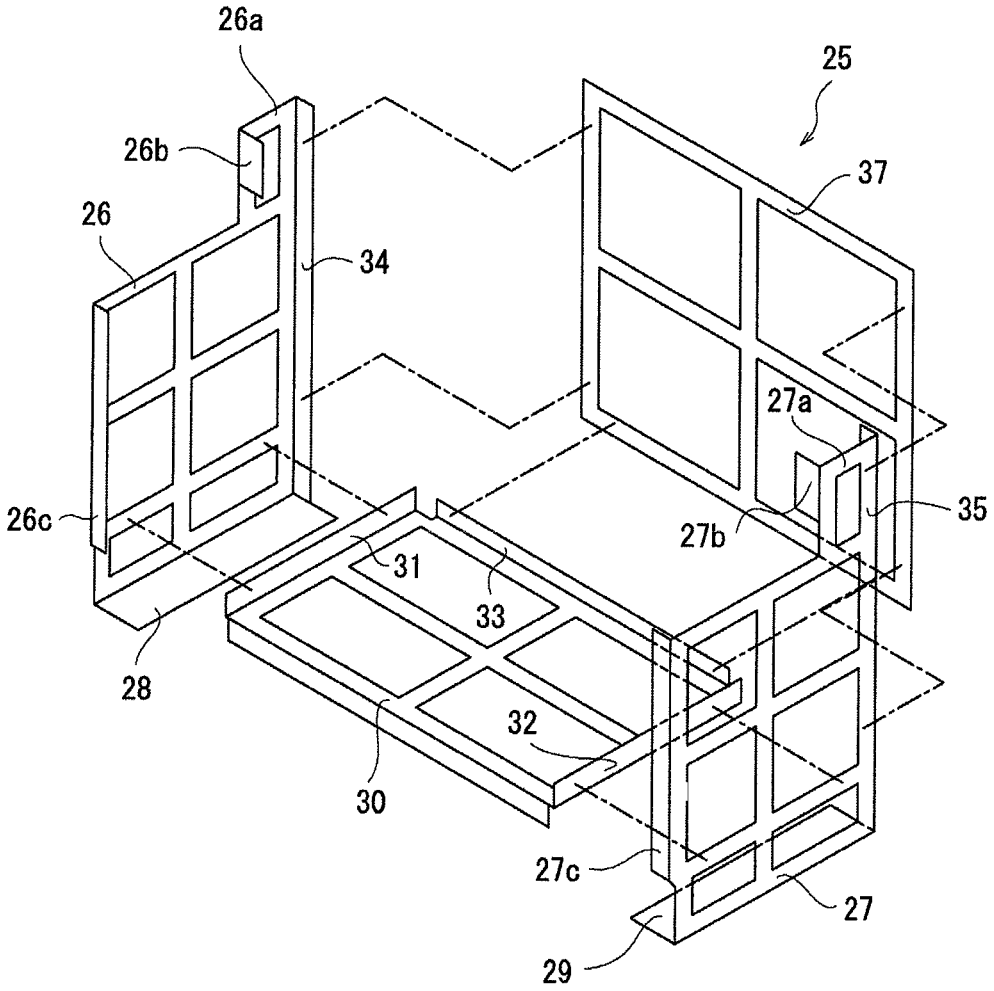
FIG. 5 is an exploded perspective view of the device receiver case of FIG. 4.

The device receiver case 22 includes a case main body 25 shown in FIG. 4. The case main body 25 is a four-surface structure including a lower surface, a left surface, a right surface, and a back surface. The case main body 25 is constituted by assembling frame-shaped members each including a plurality of openings. More specifically, the case main body 25 includes a pair of side walls 26 and 27 as shown in FIG. 5. The side walls 26 and 27 are frame-shaped members extending in the upper-lower direction. The side walls 26 and 27 are arranged so as to be opposed to each other and spaced apart from each other in the left-right direction. A lower end portion of the side wall 26 is bent toward the side wall 27, and the bent portion constitutes an attachment leg 28. A lower end portion of the side wall 27 is bent toward the side wall 26, and the bent portion constitutes an attachment leg 29. The attachment legs 28 and 29 extend in the front-rear direction along an upper surface of the floor 4 (more specifically, along an upper surface of the case receiving frame 21) and are mounted on the case receiving frame 21. Through holes (not shown) are formed on the attachment legs 28 and 29 such that the positions thereof respectively coincide with the positions of the tap holes 24*a* to 24*d* of the case receiving frame 21. Bolts inserted into the through holes are threadedly engaged with the tap holes 24*a* to 24*d*, respectively. A device receiving plate 30 is provided to extend between the side walls 26 and 27 configured as above.

The device receiving plate 30 that is a device receiving member is a frame-shaped member extending in the left-right direction and having a substantially rectangular shape in plan view. Left and right end portions of the device receiving plate 30 are bent upward, and the bent portions respectively constitute overlapping portions 31 and 32. The overlapping portions 31 and 32 extend in the front-rear direction and are arranged along and overlap inner surfaces of the side walls 26 and 27, respectively. The overlapping portions 31 and 32 are respectively fastened to the side walls 26 and 27 by fastening members, such as rivets or bolts, and respectively welded to the side walls 26 and 27*b* by spot welding. Thus, the device receiving plate 30 is arranged so as to extend between the side walls 26 and 27. The device receiving plate 30 arranged as above is provided so as to be substantially parallel to the attachment legs 28 and 29 and spaced apart from the attachment legs 28 and 29. With this, a wire space 38 is formed between the attachment legs 28 and 29 (see FIG. 4).

A front end portion of the device receiving plate 30 is bent downward, and a rear end portion of the device receiving plate 30 is bent upward. This bent portion of the rear end portion constitutes an overlapping portion 33. Further, a rear end portion of the side wall 26 is bent toward the side wall 27 (that is, toward an inner side), and the bent portion constitutes an overlapping portion 34. A rear end portion of the side wall 27 is bent toward the side wall 26 (that is, toward the inner side), and the bent portion constitutes an overlapping portion 35. These three overlapping portions 33 to 35 are arranged so as to form a substantially U shape. A back-surface plate 37 is provided at the overlapping portions 33 to 35 so as to overlap the overlapping portions 33 to 35.

The back-surface plate 37 is a frame-shaped member having a substantially rectangular shape in front view. The back-surface plate 37 is formed such that the overlapping portions 33 to 35 respectively overlap a lower edge portion, right edge portion, and left edge portion of the back-surface plate 37. The overlapping portions 33 to 35 are fastened to the back-surface plate 37 by fastening members, such as rivets or bolts, or welded to the back-surface plate 37 by spot welding. With this, the back surface of the case main body 25 is closed by the back-surface plate 37.

The side walls 26 and 27, the device receiving plate 30, and the back-surface plate 37, which are coupled to one another as above, are welded to one another by spot welding that is low in heat input. With this, heat distortion caused at the case main body 25 by the welding can be suppressed. The side walls 26 and 27, the device receiving plate 30, and the back-surface plate 37 can also be fastened to one another by fastening members, such as rivets or bolts. Thus, the heat distortion can be prevented from occurring. As above, the case main body 25 is configured such that the heat distortion can be suppressed. Thus, the four-surface structure of small heat distortion can be configured.

Figure 6:
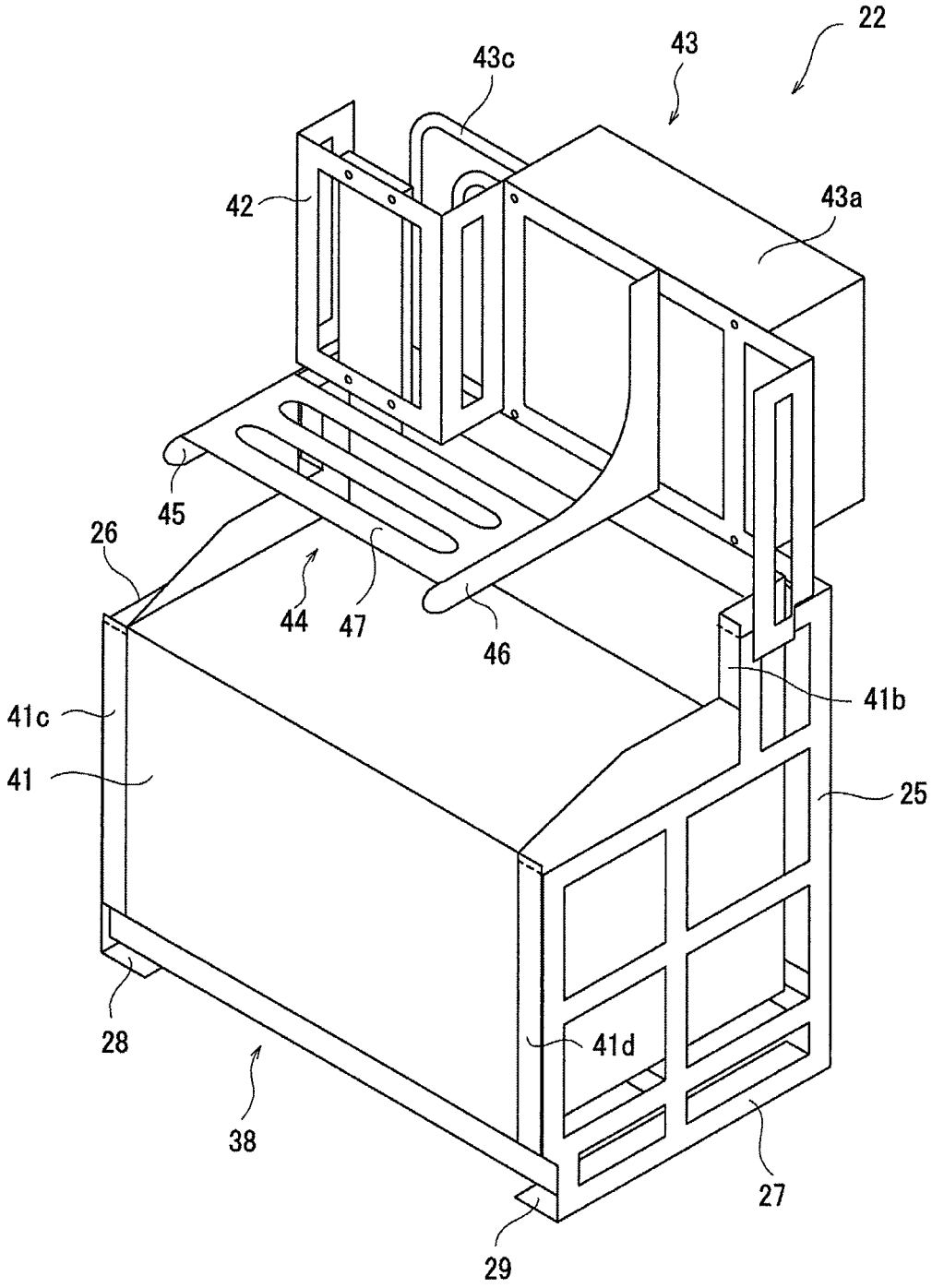
FIG. 6 is a perspective view showing a state where a device receiver is attached to the device receiver case of FIG. 3.

A front surface and upper surface of the case main body 25 having the four-surface structure configured as above are open, and as shown in FIG. 6, a first device unit 41 is stored in the case main body 25. The first device unit 41 is a device formed in a shape (substantially rectangular solid shape) that is substantially the same as the shape of an internal space of the case main body 25. The first device unit 41 is mounted on the device receiving plate 30 to be fastened to the side walls 26 and 27 by bolts.

Figure 7:
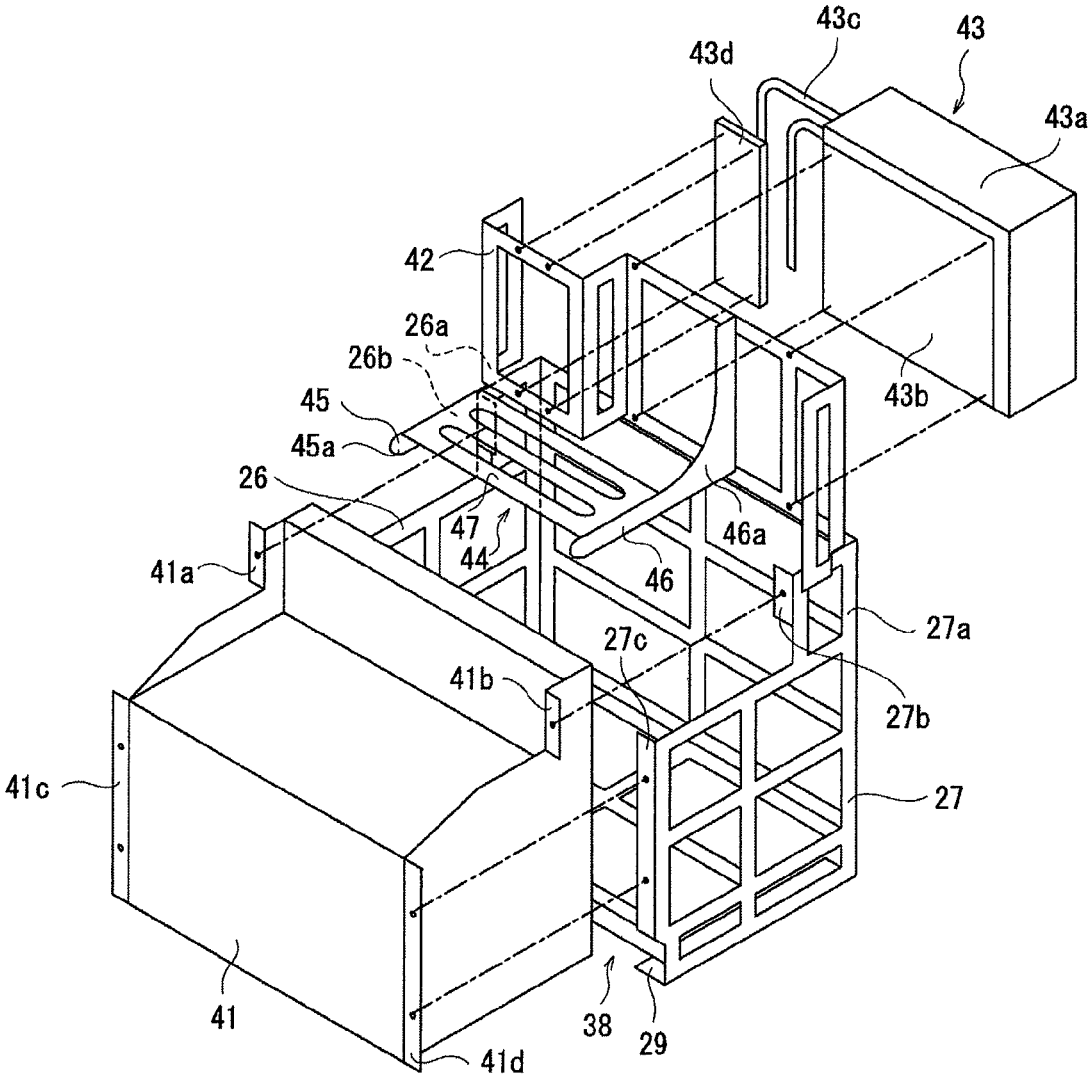
FIG. 7 is a perspective view showing a state where the device receiver is detached from the device receiver case of FIG. 6.

More specifically, a rear portion 26*a* of the side wall 26 constituting the case main body 25 is configured to project upward from the remaining portion of the side wall 26, and a rear portion 27*a* of the side wall 27 constituting the case main body 25 is configured to project upward from the remaining portion of the side wall 27. A front end of the rear portion 26*a* is bent toward the side wall 27 (that is, toward the inner side), and the bent portion constitutes an upper attaching portion 26*b*. A front end of the rear portion 27*a* is bent toward the side wall 26 (that is, toward the inner side), and the bent portion constitutes an upper attaching portion 27*b*. Similarly, a front end of the remaining portion of the side wall 26 is bent toward the side wall 27 (that is, toward the inner side), and the bent portion constitutes a lower attaching portion 26*c*. A front end of the remaining portion of the side wall 27 is bent toward the side wall 26 (that is, toward the inner side), and the bent portion constitutes a lower attaching portion 27*c*. As shown in FIG. 7, the first device unit 41 includes attachment overlapping portions 41*a* to 41*d* located at positions respectively corresponding to the upper attaching portions 26*b* and 27*b* and the lower attaching portions 26*c* and 27*c*. The first device unit 41 is stored in the case main body 25 such that the attachment overlapping portions 41*a* to 41*d* respectively overlap the upper attaching portions 26*b* and 27*b* and the lower attaching portions 26*c* and 27*c*. The attachment overlapping portions 41*a* to 41*d* are respectively fastened to the upper attaching portions 26*b* and 27*b* and the lower attaching portions 26*c* and 27*c*. A device attachment plate 42 is provided so as to extend between the rear portions 26*a* and 27*a* of the case main body 25 to which the first device unit 41 is attached as above.

As shown in FIGS. 6 and 7, the device attachment plate 42 is a frame-shaped member having a substantially S shape in plan view. A left portion of the device attachment plate 42 projects toward the rear side, and a right portion of the device attachment plate 42 projects toward the front side. Left and right end portions of the device attachment plate 42 are parallel to the front-rear direction, and lower end portions of the left and right portions project downward. These lower end portions respectively project down to upper portions of the rear portions 26*a* and 27*a* of the side walls 26 and 27 and are respectively fastened to outer sides of the upper portions of the rear portions 26*a* and 27*a* by fastening members, such as rivets or bolts. With this, the device attachment plate 42 stands on upper portions of the side walls 26 and 27. A second device unit 43 is attached to a rear surface of the device attachment plate 42 standing as above.

The second device unit 43 includes a device main body 43*a* having a substantially rectangular solid shape. A back surface 43*b* (corresponding to a front surface in FIG. 5) of the device main body 43*a* is caused to contact a rear surface of the left portion of the device attachment plate 42 to be fastened to the device attachment plate 42. The second device unit 43 includes a device member 43*d* connected to the device main body 43*a* via a wire 43*c*. The device member 43*d* is stored in the right portion of the device attachment plate 42 to be fastened to a rear surface of the right portion of the device attachment plate 42. A device receiving base 44 is provided on a front surface of the device attachment plate 42 having the rear surface to which the second device unit 43 is attached as above.

The device receiving base 44 includes a pair of supporting portions 45 and 46. Each of the supporting portions 45 and 46 has a substantially L shape in side view. A supporting part 45*a* located at a lower portion of the supporting portion 45 and a supporting part 46*a* located at a lower portion of the supporting portion 46 are provided at the device attachment plate 42 so as to project toward the front side from the device attachment plate 42. A supporting plate 47 is mounted on and fixed to upper surfaces of the supporting parts 45*a* and 46*a*. The supporting plate 47 is a frame-shaped member extending in the left-right direction and is provided so as to extend between the supporting portions 45 and 46. The device receiving base 44 configured as above is located above the case main body 25, so that the device receiving base 44 does not contact the first device unit 41 stored in the case main body 25.

Next, the attachment of the device receiver case 22 configured as above will be explained. Regarding the device receiver case 22, the case main body 25 is first assembled (that is, advanced assembly is performed), and the assembled case main body 25 is mounted on the case receiving frame 21. At this time, the case main body 25 is positioned on the case receiving frame 21 such that the through holes of the attachment legs 28 and 29 of the case main body 25 respectively coincide with the tap holes 24*a* to 24*d* of the case receiving frame 21.

In the case main body 25, the overlapping portions 31 to 35 are formed on the members 26, 27, 30, and 37, and the fastening holes are formed on the overlapping portions 31 to 35 with a high degree of positional accuracy. As described above, since the number of portions welded when assembling the members 26, 27, 30, and 37 can be minimized, the heat distortion of the case main body 25 at the time of the assembly can be suppressed, and the through holes can be arranged with a high degree of positional accuracy. As described above, the tap holes 24*a* to 24*d* are formed and arranged at the case receiving frame 21 with a high degree of positional accuracy when manufacturing the case receiving frame 21. To be specific, since the tap holes 24*a* to 24*d* and the through holes (not shown) of the attachment legs 28 and 29 are arranged with a high degree of positional accuracy, these holes can be positioned to surely coincide with each other. Therefore, it is possible to prevent a case where the through holes and the tap holes 24*a* to 24*d* do not coincide with each other, and the tap holes 24*a* to 24*d* need to be formed again. In addition, a time it takes to cause the holes to coincide with each other can be shortened.

As described above, after the tap holes 24*a* to 24*d* and the through hole are caused to coincide with each other, the bolts are inserted into the through holes to be threadedly engaged with the tap holes 24*a* to 24*d*, respectively. With this, the case main body 25 is fastened to the case receiving frame 21, and the case main body 25 is fixed to the floor 4 via the case receiving frame 21. The device attachment plate 42 and the device receiving base 44 are attached to the case main body 25. Here, the attachment of the device attachment plate 42 and the device receiving base 44 may be performed before or after the case main body 25 is fastened to the case receiving frame 21.

In the device receiver case 22 fastened to the case receiving frame 21 as above, as shown in FIG. 6, the first device unit 41 is stored in and fastened to the case main body 25, and the second device unit 43 is attached to the rear surface of the device attachment plate 42. In the case main body 25, the wire space 38 is formed by the attachment legs 28 and 29 and the device receiving plate 30, and wires (not shown) extending from respective devices provided at the driver's cab 3 are arranged in the wire space 38. The above wires and wires extending from the first device unit 41 and the second device unit 43 are connected to one another in the wire space 38. The wires extending from the first device unit 41 and the second device unit 43 can be taken out through the openings of the frame-shaped members 26, 27, 30, and 37 to the outside of the device receiver case 22. Thus, the wires extending from the first device unit 41 and the second device unit 43 are easily taken out. The storage case 23 configured separately from the device receiver case 22 is provided at an outer side of the device receiver case 22 to which the device units 41 and 43 are attached as above.

Storage Case

Figure 8:
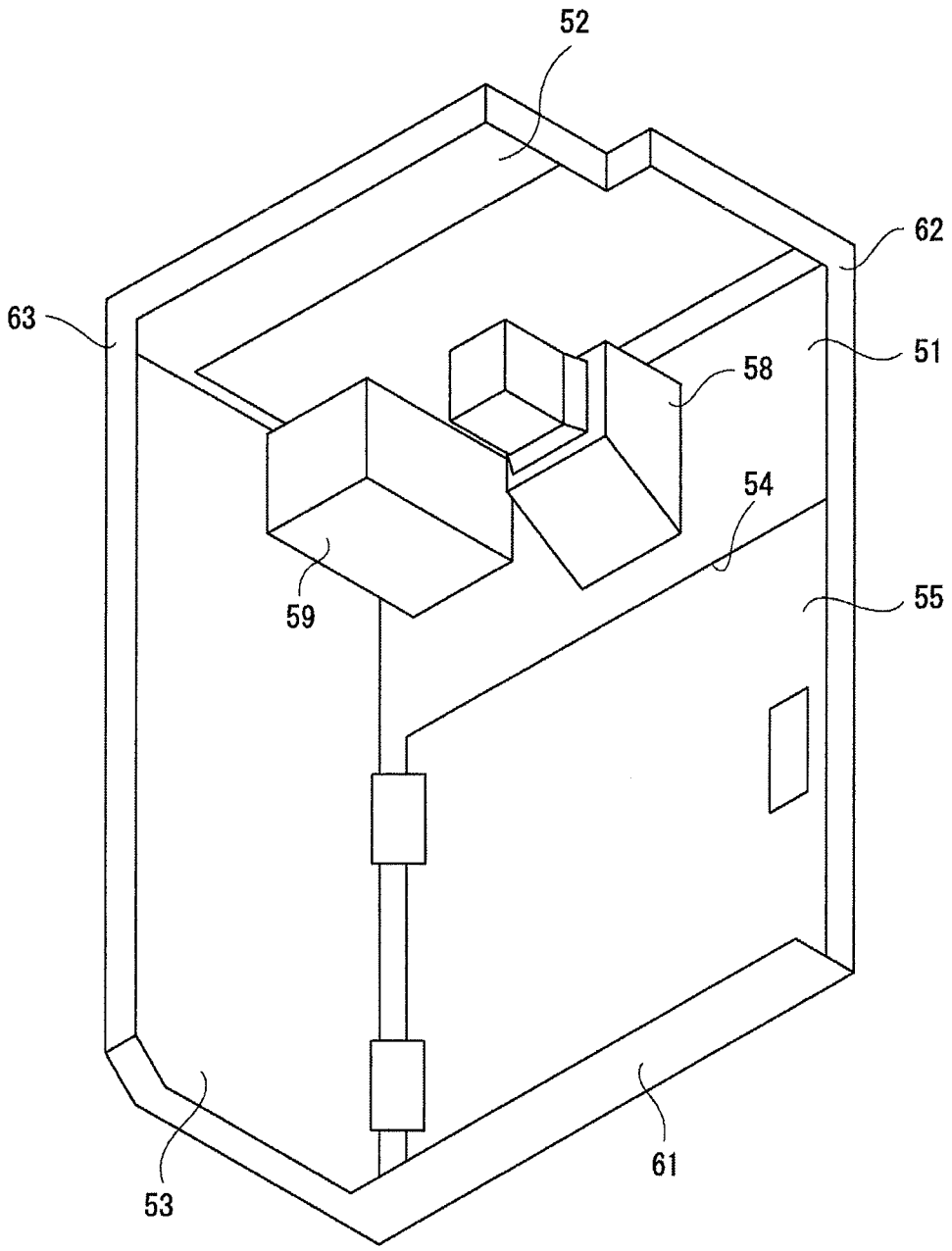
FIG. 8 is a perspective view of a storage case of FIG. 3 when viewed from below.

The storage case 23 is a three-surface structure including a front surface, an upper surface, and a left surface. As shown in FIGS. 2 and 8, the storage case 23 includes a front plate portion 51 constituting the front surface, an upper plate portion 52 constituting the upper surface, and a left plate portion 53 constituting the left surface. The front plate portion 51 has a substantially rectangular shape extending in the upper-lower direction in front view. The front plate portion 51 is formed to be higher and wider than the device receiver case 22. An inspection window 54 is formed at a lower end portion of the front plate portion 51, and an inspection door 55 is provided so as to open and close the inspection window 54. The inspection window 54 has a substantially rectangular shape in front view, and the inspection door 55 is formed to have a shape that is substantially the same as that of the inspection window 54. An operation tool window 56 and a display device window 57 are formed above the inspection window 54. Each of the operation tool window 56 and the display device window 57 has a substantially rectangular shape in front view. A part of an operation device 58 is exposed from the operation tool window 56, and a part of a display device 59 is exposed from the display device window 57.

The operation device 58 includes an operation tool 58*a*, such as an operation button. The operation device 58 is provided on a back surface (that is, a rear surface) of the front plate portion 51 such that the operation tool 58*a* is exposed from the operation tool window 56 to the outside. The display device 59 includes a display portion 59*a*, such as a display lamp or a display. The display device 59 is provided on the back surface of the front plate portion 51 such that the display portion 59*a* is exposed from the display device window to the outside. The devices 58 and 59 provided as above improve the stiffness of the storage case 23 itself.

The upper plate portion 52 is integrally provided on an upper end portion of the front plate portion 51. The upper plate portion 52 extends toward the rear side from the upper end portion of the front plate portion 51. A depth and width of the upper plate portion 52 are respectively longer than those of the device receiver case 22. The left plate portion 53 is integrally provided on left end portions of the front plate portion 51 and the upper plate portion 52. The left plate portion 53 has a substantially rectangular shape in side view. A height of the left plate portion 53 substantially coincides with that of the front plate portion 51, and a depth of the left plate portion 53 substantially coincides with that of the upper plate portion 52.

A lower end portion, right end portion, and back-surface portion of the storage case 23 configured as above are bent toward the inner side, and the bent portions respectively constitute attaching portions 61 to 63. The attaching portion 61 of the lower end portion is formed so as to extend along the case receiving frame 21. Through holes, not shown, are formed on the attaching portion 61 of the lower end portion so as to be located at positions respectively corresponding to the tap holes 24*e* to 24*f* of the case receiving frame 21. Bolts are inserted into the through holes to be threadedly engaged with the tap holes 24*e* to 24*f*, respectively. Thus, the storage case 23 is fastened to the case receiving frame 21. The attaching portion 62 of the right end portion is formed so as to be opposed to the interior portion 16 of the side bodyshell 6. The attaching portion 63 of the back-surface portion is formed so as to be opposed to the dividing plate 8. Through holes are also formed on the attaching portions 62 and 63. The storage case 23 is fastened to the interior portion 16 and the dividing plate 8 by the bolts inserted into the through holes.

After the device receiver case 22 is fixed to the case receiving frame 21, and the device units 41 and 43 are attached to the device receiver case 22, the storage case 23 configured as above is provided so as to cover the device receiver case 22. Then, the storage case 23 is positioned such that the through holes of the lower end portion are respectively located on the tap holes 24*e* to 24*f* of the case receiving frame 21. With this, the attaching portion 62 of the right end portion is opposed to the interior portion 16, and the attaching portion 63 of the back-surface portion is opposed to the dividing plate 8. The height, width, and depth of the storage case 23 are respectively larger than those of the device receiver case 22. Therefore, in a case where the storage case 23 is arranged as above, the storage case 23 covers the device receiver case 22 to store the device units 41 and 43. As above, the storage case 23 is fastened to and fixed to the case receiving frame 21, the interior portion 16, and the dividing plate 8 by the bolts so as to store the device units 41 and 43.

As above, the storage case 23 is arranged so as to cover the device receiver case 22 and then is fastened to the case receiving frame 21, the interior portion 16, and the dividing plate 8. Therefore, before arranging the storage case 23, the storage case 23 can be subjected to decorative processing, such as painting. With this, a time it takes to arrange the storage case 23 can be shortened. The storage case 23 is attached to the interior portion 16, the dividing plate 8, and the case receiving frame 21 to constitute a rectangular solid structure. With this, the stiffness of the entire storage case 23 can be improved. Therefore, the stiffness of the entire storage case 23 is maintained while omitting the frame of the storage case 23.

Other Embodiments

In the present embodiment, the device receiver case 22 is configured to have a four-surface structure. However, the device receiver case 22 may have a two-surface structure including a lower surface and a side surface or a three-surface structure including a lower surface and both side surfaces. Further, the device receiver case 22 may have a five-surface structure including a lower surface, front and rear surfaces, and left and right surfaces, other than an upper surface.

The present embodiment has explained the storage box 1 that stores the device unit included in the driver's cab 3. However, the present embodiment may be applied to the driver's platform 11 that stores driving machinery. Further, the storage box of the present embodiment is not limited to the storage box that stores the device unit included in the driver's cab 3 and may be the storage box that stores the device unit included in the passenger room or a vestibule. In addition, the present embodiment has explained the storage box fixed to the floor 4 via the case receiving frame 21. However, the present embodiment may be applied to the storage box fixed to the ceiling surface. In addition, the storage case 23 is fastened to the interior portion 16 of the side bodyshell 6 but may be fastened to the side bodyshell 6.

Further, in the present embodiment, the device receiver case 22 is constituted by the frame-shaped members. However, the device receiver case 22 may be just constituted by plate-shaped members. In the present embodiment, the attaching portions 62 and 63 of the storage case 23 are respectively fastened to the interior portion 16 and the dividing plate 8. However, the attaching portions 62 and 63 may be respectively welded to the interior portion 16 and the dividing plate 8 by spot welding. The number of welded portions can be minimized by using the spot welding, so that the heat distortion of the storage case 23 can be suppressed.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the spirit of the present invention.

REFERENCE SIGNS LIST

1 storage box
2 front car
4 floor bodyshell
8 dividing plate
10 carbody
16 interior portion
21 case receiving frame
22 device receiver case
23 storage case
24*a* to 24*f* tap hole
28, 29 attachment leg
30 device receiving plate
31, 32 overlapping portion
41 device unit
43 second device unit
58 operation device
58*a* operation tool
59 display device
59*a* display portion

The invention claimed is:

1. A dual-structure storage box of a railcar, the dual-structure storage box being positioned along an interior member located inside a carbody of the railcar and being provided at a case receiving frame fixed to a floor or ceiling plate located inside the carbody, the dual-structure storage box comprising:

a device receiver case including a device receiving member at which a device unit is placed and a pair of side walls; and a storage case configured to cover the device unit and the device receiver case from an outer side of the device unit and the device receiver case and including at least an upper surface portion or lower surface portion, a front surface portion, and a side surface portion, wherein:

both end portions of the device receiving member respectively include overlapping portions respectively formed along the side walls and respectively coupled to side surfaces of the side walls;

the side walls respectively include attachment legs respectively formed by bending lower end portions of the side walls and coupled to the case receiving frame fixed to the floor or ceiling plate located inside the carbody; and an attaching portion formed by bending a lower end portion of the front surface portion of the storage case is coupled to the case receiving frame fixed to the floor or ceiling plate located inside the carbody, and an attaching portion formed by bending an end portion of the side surface portion of the storage case is coupled to a side bodyshell of the railcar or the interior member.

2. The dual-structure storage box according to claim 1, wherein:

the device receiver case includes a back-surface plate; and overlapping portions are formed by bending rear end portions of the side walls and the device receiving member, and the overlapping portions are coupled to the back-surface plate.

3. The dual-structure storage box according to claim 1, wherein:

the interior member includes a first interior member and a second interior member which stand so as to be orthogonal to each other; and a back surface and side surface of the storage case are closed by the first interior member and the second interior member to be fastened to the first interior member and the second interior member.

4. The dual-structure storage box according to claim 1, wherein another device unit different from the device unit is provided inside the storage case such that a part of the another device unit is exposed to an outside of the storage case.

5. The dual-structure storage box according to claim 1, wherein a wire space is formed by the device receiving member and the attachment legs.

6. A railcar comprising:

a carbody including therein an interior member, a floor or ceiling plate, and a case receiving frame positioned along the interior member and fixed to the floor or the ceiling plate; and a dual-structure storage box provided at the case receiving frame, wherein:

the dual-structure storage box includes a device receiver case including a device receiving member at which a device unit is placed and a pair of side walls and a storage case configured to cover the device unit and the device receiver case from an outer side of the device unit and the device receiver case and including at least an upper surface portion or lower surface portion, a front surface portion, and a side surface portion;

both end portions of the device receiving member respectively include overlapping portions respectively formed along the side walls and respectively coupled to side surfaces of the side walls;

the side walls respectively include attachment legs respectively formed by bending lower end portions of the side walls and coupled to the case receiving frame;

an attaching portion formed by bending a lower end portion of the front surface portion of the storage case is coupled to the case receiving frame, and an attaching portion formed by bending an end portion of the side surface portion of the storage case is coupled to a side bodyshell or the interior member;

the interior member includes a first interior member and a second interior member which stand so as to be orthogonal to each other; and the case receiving frame has a substantially L shape in plan view, one of end surfaces of the case receiving frame is arranged along the first interior member, and the other end surface of the case receiving frame is arranged along the second interior member.

7. The railcar according to claim 6, wherein a back surface and side surface of the storage case are closed by the first interior member and the second interior member to be fastened to the first interior member and the second interior member.

* * * * *